US007839362B2

(12) United States Patent
Ozawa et al.

(10) Patent No.: US 7,839,362 B2
(45) Date of Patent: Nov. 23, 2010

(54) STICKING PHENOMENON CORRECTION METHOD, SELF-LUMINOUS APPARATUS, STICKING PHENOMENON CORRECTION APPARATUS AND PROGRAM

(75) Inventors: Atsushi Ozawa, Tokyo (JP); Mitsuru Tada, Tokyo (JP)

(73) Assignee: Sony Corporation, Tokyo (JP)

( * ) Notice: Subject to any disclaimer, the term of this patent is extended or adjusted under 35 U.S.C. 154(b) by 1221 days.

(21) Appl. No.: 11/324,513

(22) Filed: Jan. 4, 2006

(65) Prior Publication Data

US 2006/0164348 A1 Jul. 27, 2006

(30) Foreign Application Priority Data

Jan. 21, 2005 (JP) ..... 2005-014830

(51) Int. Cl.
*G09G 3/30* (2006.01)

(52) U.S. Cl. ..... 345/76; 345/77; 345/204; 345/214; 345/690; 315/169.3

(58) Field of Classification Search ..... 345/76–82, 345/83–100, 204, 211, 214; 315/169.3
See application file for complete search history.

(56) References Cited

U.S. PATENT DOCUMENTS

| | | | | |
|---|---|---|---|---|
| 6,501,230 | B1 * | 12/2002 | Feldman | 315/169.3 |
| 6,911,781 | B2 * | 6/2005 | Yamazaki et al. | 315/169.3 |
| 7,088,318 | B2 * | 8/2006 | Malmberg | 345/77 |
| 2002/0033783 | A1 * | 3/2002 | Koyama | 345/82 |
| 2003/0063053 | A1 * | 4/2003 | Yamazaki et al. | 345/82 |
| 2003/0071804 | A1 * | 4/2003 | Yamazaki et al. | 345/204 |
| 2004/0070558 | A1 * | 4/2004 | Cok et al. | 345/76 |

FOREIGN PATENT DOCUMENTS

| | | |
|---|---|---|
| JP | 2000-132139 | 5/2000 |
| JP | 2000-356981 | 12/2000 |
| JP | 2001-175221 | 6/2001 |
| JP | 2002-169509 | 6/2002 |
| JP | 2003-228329 | 8/2003 |
| JP | 2003-274315 | 9/2003 |
| JP | 2003-295827 | 10/2003 |
| JP | 2003-308041 | 10/2003 |

* cited by examiner

*Primary Examiner*—Richard Hjerpe
*Assistant Examiner*—Gregory J Tryder
(74) *Attorney, Agent, or Firm*—Rader, Fishman & Grauer PLLC

(57) ABSTRACT

A self-luminous apparatus is disclosed wherein a deterioration amount difference between different pixels can be eliminated accurately to correct a sticking phenomenon while the self-luminous apparatus is used. In the self-luminous apparatus, a deterioration amount difference appearing between a correction object pixel and a reference pixel within a first light emission period of time is calculated first using a deterioration ratio derived from gradation values of the pixels. Then, a deterioration ratio for correction for the correction object pixel necessary to eliminate the calculated deterioration amount difference within a second light emission period of time is derived using a deterioration ratio of the reference pixel. Thereafter, the derived deterioration ratio for correction is converted into a corresponding gradation value, and the correction object pixel is driven to emit light with the converted gradation value.

12 Claims, 6 Drawing Sheets

FIG. 2

| GRADATION VALUE | CONVERSION | DETERIORATION RATIO | LIGHT EMISSION PERIOD | DETERIORATION AMOUNT |
|---|---|---|---|---|
| 0 | ⇕ | $X_0$ | t | $R_0 = X_0 \times t$ |
| 1 | ⇕ | $X_1$ | | $R_1 = X_1 \times t$ |
| ... | ⇕ | ... | | ... |
| 254 | ⇕ | $X_{254}$ | | $R_{254} = X_{254} \times t$ |
| 255 | ⇕ | $X_{255}$ | | $R_{255} = X_{255} \times t$ |

STICKING PHENOMENON CORRECTION METHOD, SELF-LUMINOUS APPARATUS, STICKING PHENOMENON CORRECTION APPARATUS AND PROGRAM

CROSS REFERENCES TO RELATED APPLICATIONS

The present invention contains subject matter related to Japanese Patent Application JP 2005-014830 filed with the Japanese Patent Office on Jan. 21, 2005, the entire contents of which being incorporated herein by reference.

BACKGROUND OF THE INVENTION

The present invention relates to a correction method of a sticking phenomenon which appears in a self-luminous apparatus, a sticking phenomenon correction apparatus, a self-luminous apparatus in which a sticking phenomenon correction apparatus is incorporated, and a program for causing a computer incorporated in a self-luminous apparatus to execute a sticking correction process.

A flat panel display unit has spread widely in various products such as computer display units, portable terminal units, television sets and so forth. At present, while a liquid crystal display panel is used frequently, subjects of a limited angular field of view and a low responding speed still remain pointed out.

On the other hand, an organic EL display unit formed from self-luminous elements can overcome the subjects of the angular field of view and the responding speed described above and can achieve a form of a reduced thickness which eliminates a backlight, a high luminance and a high contrast. Therefore, the organic EL display unit is expected as a next generation display apparatus in place of a liquid crystal display unit.

Incidentally, it is commonly known that self-luminous elements including organic EL elements have a characteristic of deteriorating in accordance with the emitted light amount and the light emission time period thereof.

Meanwhile, the substance of an image to be displayed on a display unit is not uniform. Therefore, deterioration of self-luminous elements is likely to proceed locally. For example, deterioration of self-luminous elements in a time displaying region (fixed displaying region) proceeds more rapidly than that of self-luminous elements in the other displaying region (dynamic image displaying region).

The luminance of a self-luminous element whose deterioration has proceeded is relatively lower than that of self-luminous elements in the other displaying region. Generally, the phenomenon just described is called "sticking". Local deterioration of self-luminous elements is hereinafter referred to as "sticking".

Various methods are examined as improving measures against the sticking phenomenon. Some of such methods are disclosed in the following documents.

1. Japanese Patent Laid-open No. 2003-228329 (hereinafter referred to as Patent Document 1) discloses a method wherein input data to pixels which form a display panel are integrated for each of the pixels and integrated values of the pixels are subtracted from a maximum value of the input data to set correction amounts for the pixels. Further, Patent Document 1 discloses a method wherein, when the display panel is in a non-used state, each pixel is driven to emit light with a fixed luminance for a time period which increases in proportion to the magnitude of a correction amount therefore to make the displaying characteristics of the pixels uniform.

2. Japanese Patent Laid-open No. 2003-295827 (hereinafter referred to as Patent Document 2) discloses a method wherein display data and a display time period are stored only when a still picture is displayed and the integration amount $\Delta Y \cdot T$ obtained by integrating the difference $\Delta Y$ between the display data and a maximum luminance and the time period T for which the still picture is displayed is set as correction data. Patent Document 2 further discloses a method wherein display for correction is executed only in a state wherein a cover is closed or in a non-used state of the apparatus to correct the sticking phenomenon.

3. Japanese Patent Laid-open No. 2000-132139 (hereinafter referred to as Patent Document 3) discloses a method wherein input data are integrated for each of pixels and the calculated integration value is converted into a correction value using a correction table. Further, Patent Document 3 discloses a method wherein input data to each of the pixels is corrected with the calculated correction value to decrease the visibility of the sticking phenomenon.

4. Japanese Patent Laid-open No. 2001-175221 (hereinafter referred to as Patent Document 4) discloses a method wherein a pixel whose luminance is most deteriorated is detected from among pixels and a correction value is determined so that luminance data of the other pixels are decreased with reference to the detected pixel. Further, Patent Document 4 discloses a method wherein the luminance data of the pixels are converted with the calculated correction value to decrease the visibility of the sticking phenomenon.

5. Japanese Patent Laid-open No. 2002-169509 (hereinafter referred to as Patent Document 5) discloses a method wherein the luminance of an entire panel is suppressed when a still picture is displayed or a reverse bias is applied to light emitting elements when the panel is in a standby mode to suppress unnecessary charge from being accumulated between electrodes of the light emitting elements thereby to lower the deterioration speed of the displaying characteristic to suppress appearance of the sticking phenomenon.

6. Japanese Patent Laid-open No. 2000-356981 (hereinafter referred to as Patent Document 6) discloses a correction method wherein the time period within which a panel emits light is accumulated and the luminance of the entire panel is suppressed in response to the accumulated time period. The correction method achieves reduction of the sticking phenomenon by suppressing the deterioration rate of the light emission characteristic.

7. Japanese Patent Laid-open No. 2003-308041 (hereinafter referred to as Patent Document 7) discloses a correction method wherein a moving picture region and a still picture region are decided on a screen and the luminance only in the still picture region is suppressed to delay appearance of the sticking phenomenon in the still picture region.

8. Japanese Patent Laid-open No. 2003-274315 (hereinafter referred to as Patent Document 8) discloses a correction method wherein an entire screen is displaced in a unit of a pixel in a certain cycle to cause a shading off effect to occur at the contour of a sticking portion to make the sticking phenomenon less conspicuous.

SUMMARY OF THE INVENTION

Existing correction techniques including the correction techniques described above can generally be classified into the following four types:

1. a method wherein the sticking phenomenon itself is made less conspicuous;

2. a method wherein the luminance is suppressed wholly to lower the speed of occurrence of the sticking phenomenon;

3. a method wherein gradation data of deteriorated pixels are raised or gradation data of pixels which are not deteriorated are lowered to make the luminance characteristics of the pixels uniform thereby to make the sticking phenomenon invisible; and 4. a method wherein, when the display panel is not used, correction display wherein the differences between dispersed accumulated emission light amounts are made up by input data is performed.

Incidentally, the methods 1 and 2 described above do not fundamentally solve the cause of occurrence of the sticking phenomenon and have a problem in that the sticking phenomenon is visually recognized soon.

Meanwhile, the method 3 rather increases the deterioration amount difference between self-luminous elements and has problems that the time of the limit to correction is accelerated and that the life is shortened by a drop of the total luminance.

Further, the method 4 does not guarantee that, in an actual manner of use, an unused state sufficient for correction can always be assured, resulting in the possibility that the correction may be performed but not fully. In addition, the method 4 has another problem that, even when the display panel is not in a used state, power is consumed for the sticking correction.

Furthermore, according to the method 4, the integrated amounts of gradation values are adjusted in accordance with the assumption that a proportional relationship is satisfied between deterioration of the light emission characteristic and the display gradation. However, the assumption has not yet actually been proved correct successfully. For example, it has been reported that one step on the high gradation value (high luminance) side sometimes accelerates the deterioration rate more than one step on the low deterioration value (low luminance) side. Therefore, the method 4 has a problem that the adjustment of the integration values of gradation values does not always result in uniformization in deterioration of the light emission characteristics.

Taking the technical subjects described above, the inventors of the present invention proposes the following technical countermeasure.

In particular, according to the present invention, there is provided a sticking phenomenon correction method for correcting a sticking phenomenon of a self-luminous apparatus wherein a plurality of self-luminous elements are arranged in a matrix while the self-luminous apparatus is in a used state, including the steps of calculating a deterioration amount difference appearing between a correction object pixel and a reference pixel within a first light emission period of time using a deterioration ratio derived from gradation values of the pixels, deriving a deterioration ratio for correction for the correction object pixel necessary to eliminate the calculated deterioration amount difference within a second light emission period of time using a deterioration ratio of the reference pixel, converting the derived deterioration ratio for correction into a corresponding gradation value, and driving the correction object pixel to emit light with the converted gradation value.

The deterioration ratio is a value obtained by converting a drop of the emission light amount into a value per unit period of time. The deterioration ratio is determined from an actually measured value of a light emission characteristic. For example, the deterioration ratio is given as a value obtained by converting a dropping amount of the luminance actually measured when emission of light with an individual gradation value continues for a certain period of time into a value per unit period of time.

Meanwhile, the self-luminance apparatus may be any of an organic EL (electroluminescence) panel, a PDP (plasma display panel), a CRT (cathode ray tube), an FED (field emission display) panel, an LED (light emitting diode) panel, and a projector.

In the sticking phenomenon correction method, individual gradation values of a correction object pixel and a reference pixel are converted into deterioration values to calculate a deterioration amount difference between the pixels. In other words, the deterioration ratios which are parameters which reflect actual light emission characteristics of the pixels are used to calculate the deterioration amount difference. Consequently, a deterioration ratio (that is, a gradation value) necessary to eliminate the deterioration amount difference, which appears within the first light emission period, within the second light emission period can be determined accurately.

Further, with the sticking phenomenon correction method, a correction process can be executed while the self-luminous apparatus is in a used state. Therefore, useless consumption of the power can be prevented effectively.

The above and other objects, features and advantages of the present invention will become apparent from the following description and the appended claims, taken in conjunction with the accompanying drawings in which like parts or elements denoted by like reference symbols.

BRIEF DESCRIPTION OF THE DRAWINGS

FIG. 2 is a view showing an example of a table in which a coordinated relationship between gradation values and deterioration rates is retained;

DETAILED DESCRIPTION OF THE PREFERRED EMBODIMENT

Figure 1:
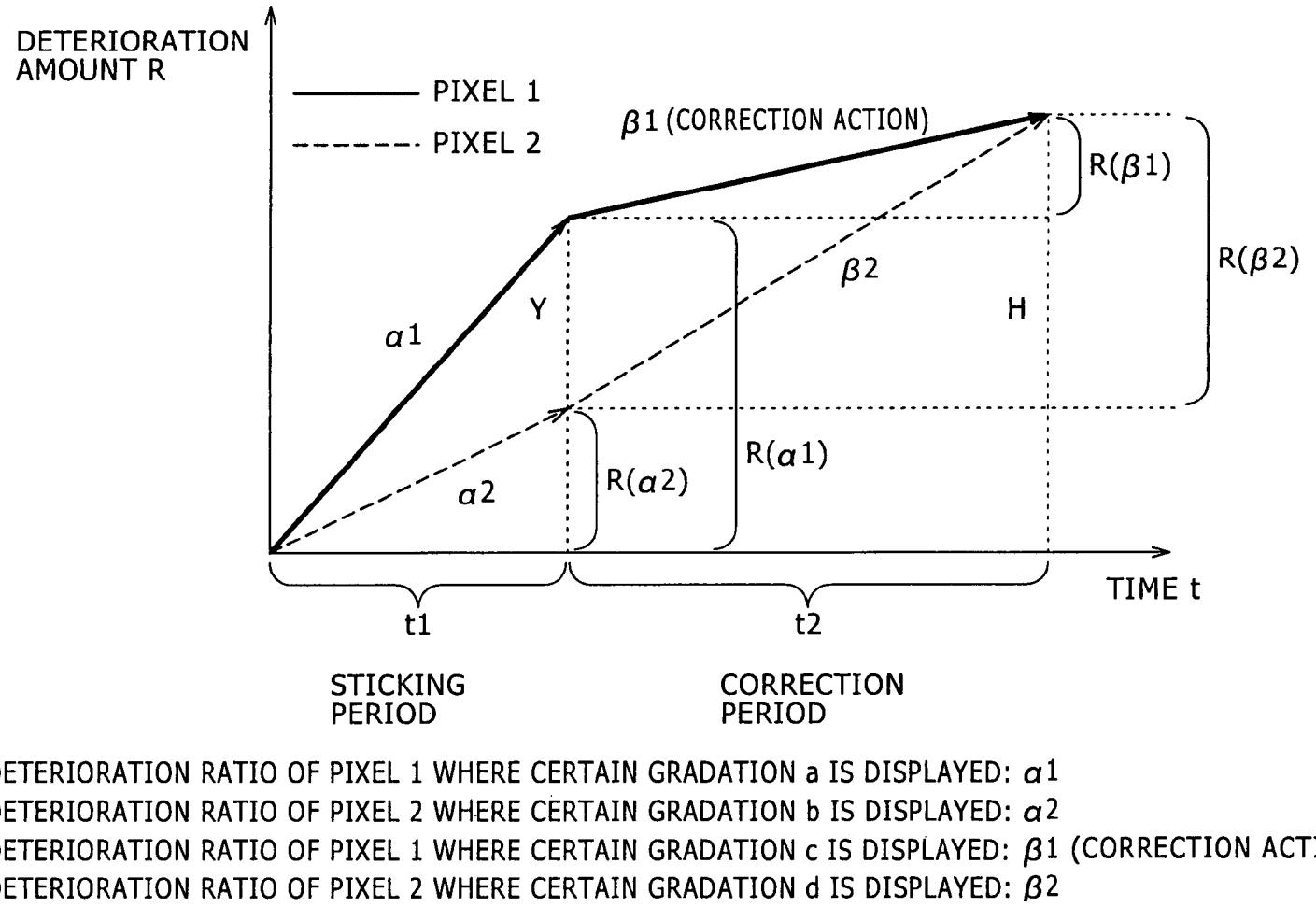
FIG. 1 is a diagram illustrating a principle of correction of a sticking phenomenon.

In the following, an embodiment of a sticking correction technique which adopts a technical method according to the present invention is described.

It is to be noted that a well-known or publicly known technique in the pertaining technical field is applied to any item which is not particularly disclosed in the present specification or in the accompanying drawings.

A. Study of the Sticking Phenomenon

A "sticking phenomenon" is a phenomenon that two pixels having an initial characteristic that they emit light with an equal luminance if they are driven in the same driving conditions emit light with different luminances even when they are driven in the same driving conditions.

Self-luminous devices have individual lives and have a light emission characteristic that, as deterioration thereof proceeds, even if the same driving conditions are applied, the initial luminance is lost gradually. In other words, the self-luminous devices have a light emission characteristic that the screen thereof becomes darkened gradually.

This light emission characteristic is a phenomenon which may not be avoided in the present situation. In particular, it is known that the light emission characteristic of self-luminance devices uniformly proceeds in a deteriorating direction, and a phenomenon that the light emission characteristic is restored has not been confirmed at present.

Incidentally, if the deterioration of pixels proceeds uniformly with respect to time in any condition, then no light emission luminance difference appears in the same driving conditions. In other words, the pixels merely become darkened by an equal amount and no sticking condition is visually recognized.

It has been reported recently that the rate of deterioration of pixels is not uniform but varies complicatedly in response to the light emission luminance and environmental factors (for example, a heat generation temperature) upon light emission. Further, a phenomenon has been reported that pixels whose deterioration has proceeded at different rates within a certain period of time emit light with different luminances even if the same driving conditions are applied. In other words, it has been reported that a sticking phenomenon is visually recognized.

B. Study of the Correction Method

Usually, the life of a light emitting device is prescribed based on a drop of the light emission luminance. Therefore, the inventors of the present invention propose a method of evaluating a deterioration amount using a parameter referred to as deterioration ratio representative of a dropping ratio of the luminance.

In particular, a gradation value is converted into a deterioration ratio which provides a deterioration rate to calculate a deterioration amount which appears within a certain period of time. Then, a correction value is determined so as to eliminate the difference between deterioration amounts of pixels calculated in this manner.

It is to be noted that the deterioration ratio is a parameter which reflects a drop of the light emission luminance and accurately reflects the deterioration of the light emission characteristic which actually occurs with a self-luminous device.

The correction of a sticking phenomenon is implemented by eliminating the deterioration amount difference, which has appeared between two pixels within a certain period of time, within a designated period of time. The following two methods are available for the correction.

(1) A Method Wherein a Deterioration Amount Difference Between Two Arbitrary Points is Eliminated In this instance, one of the two points is treated as a reference pixel while the other is treated as a correction object pixel. In the correction process, light emission conditions to be settled for the reference pixel and a designated period are used to determine light emission conditions with which the deterioration amount difference can be reduced to zero. The correction object pixel is driven to emit light with the determined light emission conditions.

(2) A Method Wherein a Reference Pixel is Set or Assumed Separately and a Deterioration Amount Difference Between Two Points is Eliminated In this instance, a reference pixel is set or assumed in addition to two pixels and the two pixels are treated as correction object pixels. In the correction process, light emission conditions to be settled for the reference pixel and a designated period are used to determine light emission conditions for the correction object pixels with which the differences in deterioration amount which exist between the reference pixel and the correction object pixels can individually be reduced to zero. The correction object pixels are driven to emit light with the determined light emission conditions.

It is to be noted that the reference pixel may be an actually existing pixel which composes the self-luminous apparatus or may be set as an imaginary pixel. For example, an average value over the screen may be used as a gradation value of the reference pixel.

Further, any number of reference pixels may be set. For example, one reference pixel may be determined for each light emission color over the overall screen. In this instance, the proceeding rate of deterioration can be made uniform over the overall screen.

Also it is possible to divide and manage the overall area of the screen into and as a plurality of regions in each of which one reference pixel is determined for each light emission color. For example, the overall area of the screen may be divided into and managed as a still picture region and a moving picture region. In this instance, the proceeding rate of deterioration can be made uniform in each of the regions.

Also it is possible to determine one of two or more pixels selected arbitrarily as a reference pixel. In this instance, the proceeding rate of deterioration can be made uniform within the range of the arbitrary pixels.

C. Derivation of Correction Conditions

In the present embodiment, a flat display panel is used as the self-luminous device.

FIG. 1 illustrates a principle of correction of a sticking phenomenon, that is, a procedure after appearance till elimination of a sticking phenomenon. It is to be noted that, in FIG. 1, two pixels, that is, a reference pixel and a correction object pixel, presumably have the same initial condition.

Referring to FIG. 1, a pixel 1 is determined as the correction object pixel and another pixel 2 is determined as the reference pixel. Incidentally, the pixels 1 and 2 are selected as pixels having the smallest distance between them from among those pixels which emit light of the same color. The emission light color here may be any of the three primary colors of red, blue and green. Naturally, where a light source for white color is used, the emission color light is the white color.

FIG. 1 illustrates a variation of the deterioration amount where the pixels emit light in the following light emission conditions.

<Light Emission Period t1>

Pixel 1: emits light with a fixed gradation value a

Pixel 2: emits light with another fixed gradation value b ($\neq$a)

<Light Emission Period t2>

Pixel 1: emits light with a further fixed gradation value c (correction action)

Pixel 2: emits light with a still further fixed gradation value d ($\neq$c)

In the procedure of FIG. 1, at a point of time at which the light emission period t1 elapses, a deterioration amount difference Y is found between the deterioration amount R ($\alpha$1) of the pixel 1 and the deterioration amount R ($\alpha$2) of the pixel 2. In other words, appearance of a sticking phenomenon is found.

Here, the deterioration amount of each pixel which appears in the light emission period t1 is represented as a value obtained by multiplying the deterioration ratio (deterioration ratio per unit period of time) which is influenced by the emission light luminance of the pixel (for example, amount of electric current flowing through an organic EL device) or the heat generation temperature then by the light emission period t1.

Accordingly, the deterioration amount R ($\alpha 1$) of the pixel 1 is represented by $\alpha 1 \times t1$. Here, $\alpha 1$ is a deterioration ratio derived from the gradation value a which provides the emission light luminance within the light emission period t1.

Similarly, the deterioration amount R ($\alpha 2$) of the pixel 2 is represented by $\alpha 2 \times t1$. Here, $\alpha 2$ is a deterioration ratio derived from the gradation value b which provides the emission light luminance within the light emission period t1.

As a result, the deterioration amount difference Y between the two pixels which appears within the light emission period t1 can be represented by R ($\alpha 1$)−R ($\alpha 2$). In other words, the deterioration amount difference Y can be represented as Y=R ($\alpha 1$)−R ($\alpha 2$)=($\alpha 1-\alpha 2$)×t1. It is to be noted that $\alpha 1-\alpha 2$ corresponds to the sticking ratio.

Here, the light emission period t2 is described. It is to be noted that the deterioration amount of the pixel 1 which newly appears within the light emission period t2 is represented by R ($\beta 1$) and the deterioration amount of the pixel 2 is represented by R ($\beta 2$). Here, $\beta 1$ is a deterioration ratio derived from a gradation value c which provides the emission light luminance within the light emission period t2 with regard to the pixel 1. Meanwhile, $\beta 2$ is a deterioration ratio derived from another gradation value d which provides the emission light luminance within the light emission period t2 with regard to the pixel 2.

In this instance, the deterioration amount R ($\beta 1$) of the pixel 1 which newly appears within the light emission period t2 is represented by R ($\beta 1$)=$\beta 1 \times t2$.

Meanwhile, the deterioration amount R ($\beta 2$) of the pixel 2 which newly appears within the light emission period t2 is represented by R ($\beta 2$)=$\beta 2 \times t2$.

Accordingly, the deterioration amount difference H between the pixel 1 and the pixel 2 which appears within the light emission period t2 is represented by R ($\beta 2$)−R ($\beta 1$). In other words, the deterioration amount difference H can be represented as H=R ($\beta 2$)−R ($\beta 1$)=($\beta 2-\beta 1$)×t2. It is to be noted that $\beta 2-\beta 1$ corresponds to the correction ratio.

Here, if Y=H is satisfied, then the gradation amount difference between the pixel 1 and the pixel 2 can be returned fully to zero. In other words, if the same driving conditions are applied to the pixel 1 and the pixel 2 after lapse of the light emission period t2, then a state wherein the two pixels emit light with an equal luminance can be created.

In the present embodiment, the pixel 2 is the reference pixel. Accordingly, the deterioration ratio $\beta 1$ of the pixel 1 necessary to eliminate the deterioration amount difference in the light emission period t2 can be calculated, from the conditional expression of Y=H, in accordance with an expression of $\beta 1=\beta 2-(\alpha 1-\alpha 2)\times t1/t2$.

It is to be noted that the self-luminous device is driven based on the gradation value. Accordingly, the deterioration ratios $\beta 1$ and $\beta 2$ which satisfy the condition to eliminate the deterioration amount difference should be applied to the self-luminous device after they are converted back into gradation values.

D. Gradation Value-Deterioration Ratio Conversion Table

As described hereinabove, the correction process requires a process of deriving a deterioration ratio from a gradation value and another process of deriving a gradation value from the deterioration value.

Here, as an example of a method of implementing the conversion processes, a method which uses a conversion table is described.

FIG. 2 shows an example of the conversion table. Table information is set based on a corresponding relationship between the gradation value and the deterioration ratio acquired by an experiment conducted in advance.

The inventors of the present invention propose the following technique as an example of an experiment for determining the table information.

For example, a process of actually measuring a decreasing amount of the luminance which is actually measured when the self-luminous device is kept lit for a fixed period of time with a certain fixed gradation value with respect to an initial luminance of the maximum gradation value (for example, in the case of 8 bits, 255), that is, a luminance decreasing ratio, is repeated for all gradation values.

It is to be noted that, where the number of gradations is great, a method may be used wherein suitable gradation values are sampled and a relational expression to be used for the calculation is derived from a result of the sampling.

FIG. 2 represents a corresponding relationship between gradation values and deterioration ratios. For example, the deterioration ratio corresponding to the gradation value "n" is represented as "$X_n$". It is to be noted that, since the table of FIG. 2 is for 8 bits, n is given as a value ranging from 0 to 255.

FIG. 2 further represents a conversion relationship between the deterioration ratios and the deterioration amounts. Where the emission light period is "t", the deterioration amount "$R_n$" corresponding to the deterioration ratio "$X_n$" is given as "$X_n \times t$". Where the light emission periods t1 and t2 are fixed, if the values corresponding to values of the light emission periods t1 and t2 are registered, then an arithmetic operation process for the conversion can be omitted.

It is to be noted that the conversion table can be used to read out a deterioration ratio based on a gradation value and read out a gradation value based on a deterioration ratio conversely.

E. Correction Process of a Sticking Phenomenon

Figure 3:
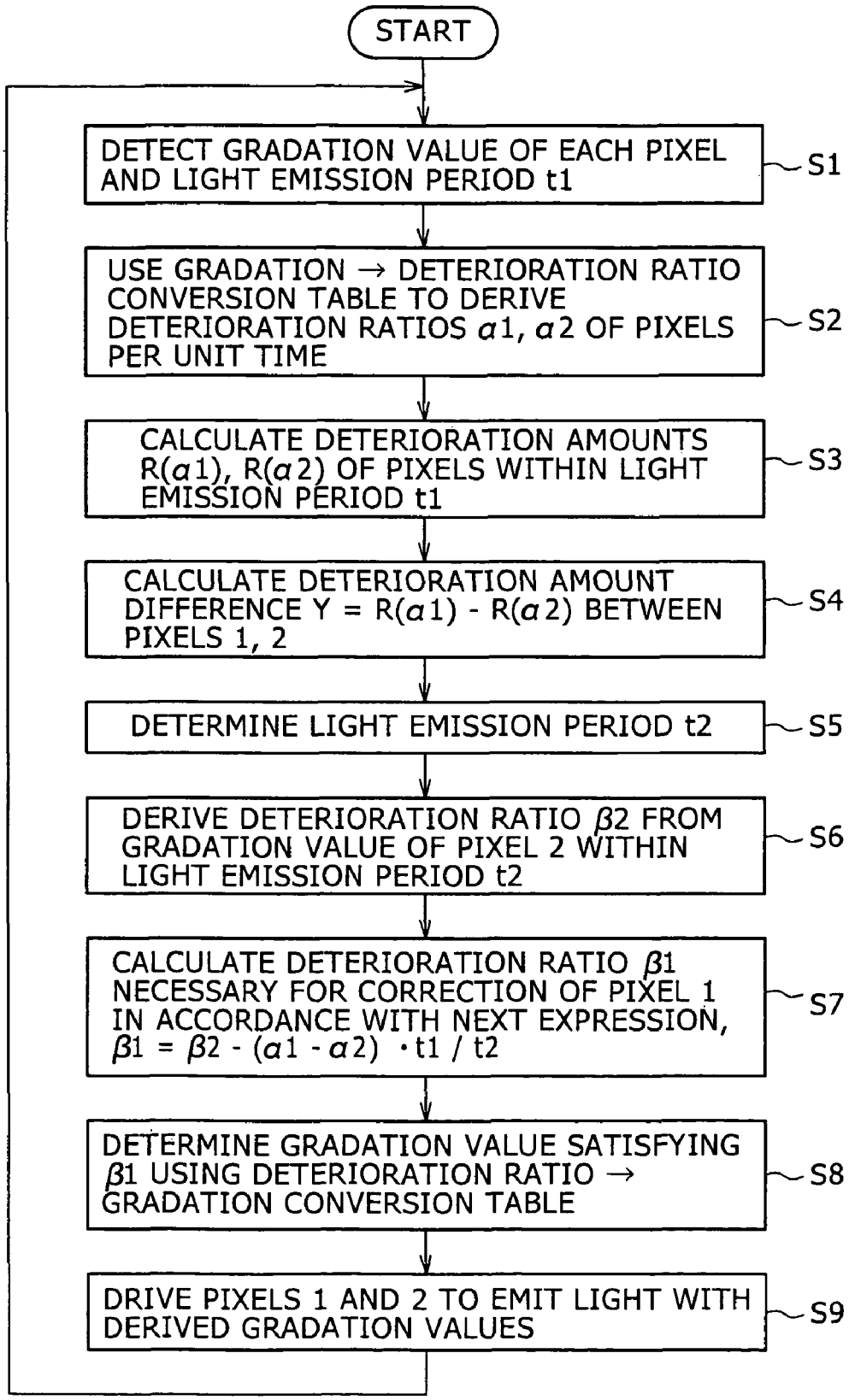
FIG. 3 is a flow chart illustrating an example of a correction process of a sticking phenomenon.

FIG. 3 illustrates an example of a processing action for correcting a deterioration amount difference (sticking phenomenon) appearing within a certain light emission period t1.

First, an input gradation value and a light emission period t1 are detected with regard to the pixel 1 and the pixel 2 which emit light with different luminance values (step S1).

Then, deterioration values corresponding to the individual input gradation values of the pixel 1 and the pixel 2 are derived using the conversion table shown in FIG. 2. In other words, the deterioration value $\alpha 1$ of the pixel 1 and the deterioration value $\alpha 2$ of the pixel 2 are derived (step S2).

After the deterioration values $\alpha 1$ and $\alpha 2$ are obtained, they are multiplied by the light emission period t1 to calculate the deterioration amount R ($\alpha 1$) of the pixel 1 within the light emission period t1 and the deterioration amount R ($\alpha 2$) of the pixel 2 within the light emission period t1 are calculated (step S3).

Then, the difference between the deterioration amounts, that is, "R ($\alpha 1$)−R ($\alpha 2$)", is calculated. In other words, the deterioration amount difference Y appearing between the two pixels 1 and 2 is calculated, that is, a sticking amount is calculated (step S4).

Thereafter, a light emission period t2 is determined as a correction period. The light emission period t2 can be set to an arbitrary value. However, it is a precondition that the light emission period t2 satisfies a conditional expression "$\beta 1=\beta 2-(\alpha 1-\alpha 2)\times t1/t2$ (step S5) which is used in a process at a later step (step S7). It is to be noted that the light emission period t2 may be set equal to the light emission period t1. In this instance, the conditional expression can be simplified.

Then, from the gradation value d which provides an emission light luminance of the pixel 2 within the light emission period t2, a corresponding deterioration ratio β2 is derived (step S6). Naturally, the conversion table shown in FIG. 2 is used for the derivation of the deterioration ratio β2.

Through the processes described, all values (deterioration ratios α1, α2 and β2 and light emission periods t1 and t2) necessary for calculation of a correction value are settled.

Thereafter, the correction conditional expression is used to determine the deterioration ratio β1 for eliminating the deterioration amount difference (step S7) In particular, $\beta1=\beta2-(\alpha1-\alpha2)\times t1/t2$ is used to calculate the deterioration ratio β1.

The deterioration ratio β1 determined finally is converted into a corresponding gradation value c (step S8). The gradation value c is derived using the conversion table.

As a result, the pixel 1 emits light with the gradation value c over the light emission period t2 and the pixel 2 emits light with the gradation value d over the light emission period t2 (step S9).

In other words, as a result of the correction process of a sticking phenomenon, the gradation value of the pixel 1 is replaced with the gradation value c different from the gradation value prior to the correction.

By the correction process described, the deterioration difference between the same color pixels appearing in the light emission period t1 is eliminated with certainty.

F. Examples of a Sticking Phenomenon Correction Apparatus a. Example 1

Figure 4:
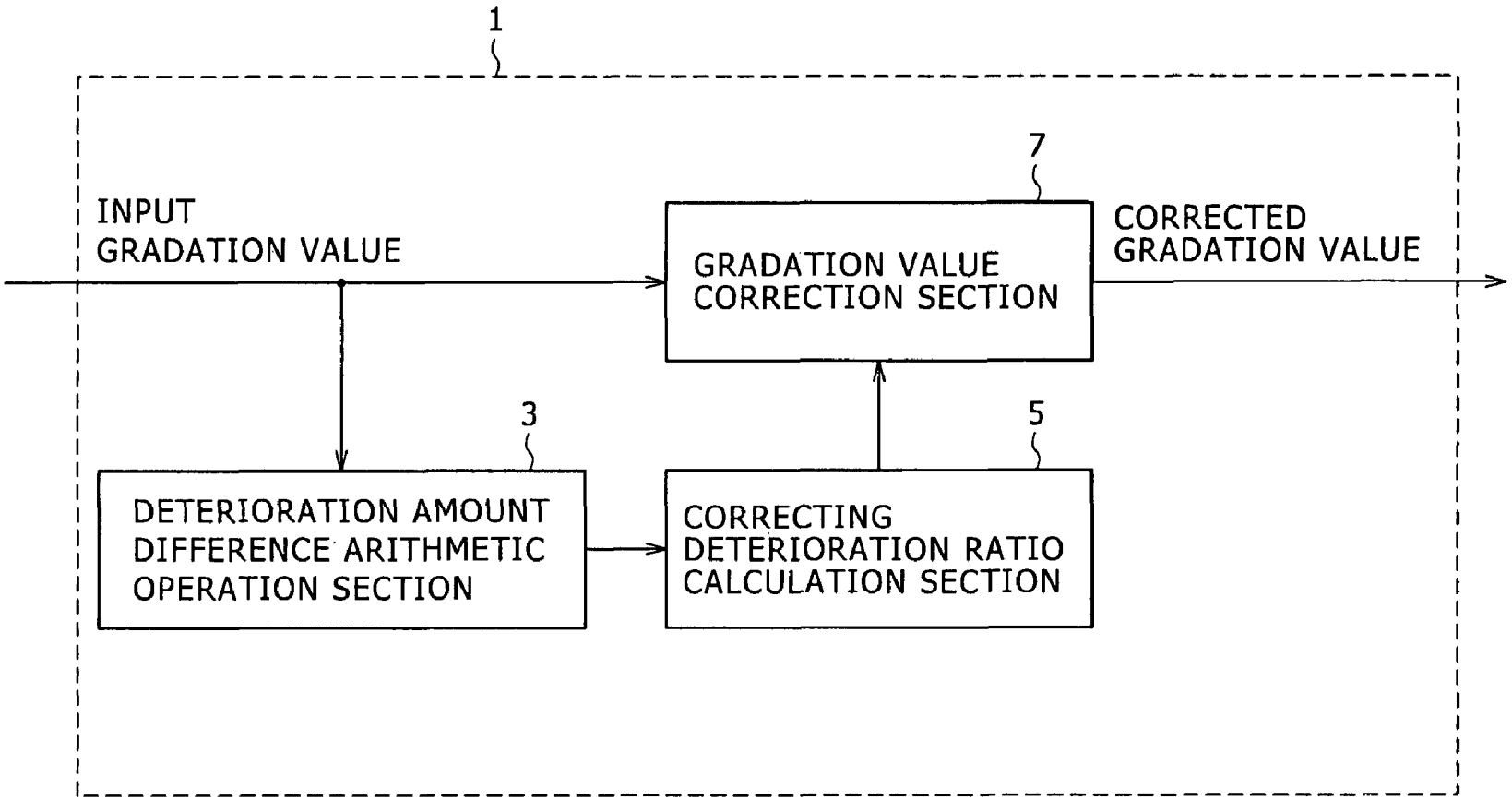
FIG. 4 is a block diagram showing an example of a sticking phenomenon correction apparatus.

FIG. 4 shows an example of a form of a sticking phenomenon correction apparatus where it is implemented by hardware. The present example corresponds to a case wherein the conversion process from a gradation value to a deterioration ratio and the conversion process from the deterioration ratio to a gradation value are implemented by arithmetic operation.

In this instance, the sticking phenomenon correction apparatus 1 can be composed of a deterioration amount difference arithmetic operation section 3, a correcting deterioration ratio calculation section 5 and a gradation value correction section 7.

The deterioration amount difference arithmetic operation section 3 is a processing device which calculates the deterioration amount difference Y appearing between the pixel 1 and the pixel 2 within the light emission period t1. In particular, the deterioration amount difference arithmetic operation section 3 uses the deterioration ratios α1 and α2 corresponding to the gradation values a and b corresponding to the pixels to calculate the deterioration amount difference Y ($=(\alpha1-\alpha2)\cdot t1$). It is to be noted that the deterioration ratio corresponding to a gradation value is determined by an arithmetic operation process.

The correcting deterioration ratio calculation section 5 is a processing device which derives the deterioration ratio β1 for correction necessary to eliminate the calculated deterioration amount difference Y within the light emission period t2 as a correction period with reference to the deterioration ratio β1 of the pixel 2 ($=\beta2-(\alpha1-\alpha2)\cdot t1/t2$).

The gradation value correction section 7 is a processing device which converts the derived deterioration ratio β1 for correction into a corresponding gradation value c and replacing the determined gradation value c into the input gradation value of the pixel 1.

In FIG. 4, a gradation value prior to correction is represented as input gradation value, and a gradation value after correction is represented as corrected gradation value. It is to be noted that the input gradation value of the pixel 2 set as the reference pixel is outputted as it is.

Also in this instance, the gradation value corresponding to a deterioration ratio is determined by an arithmetic operation process.

b. Example 2

Figure 5:
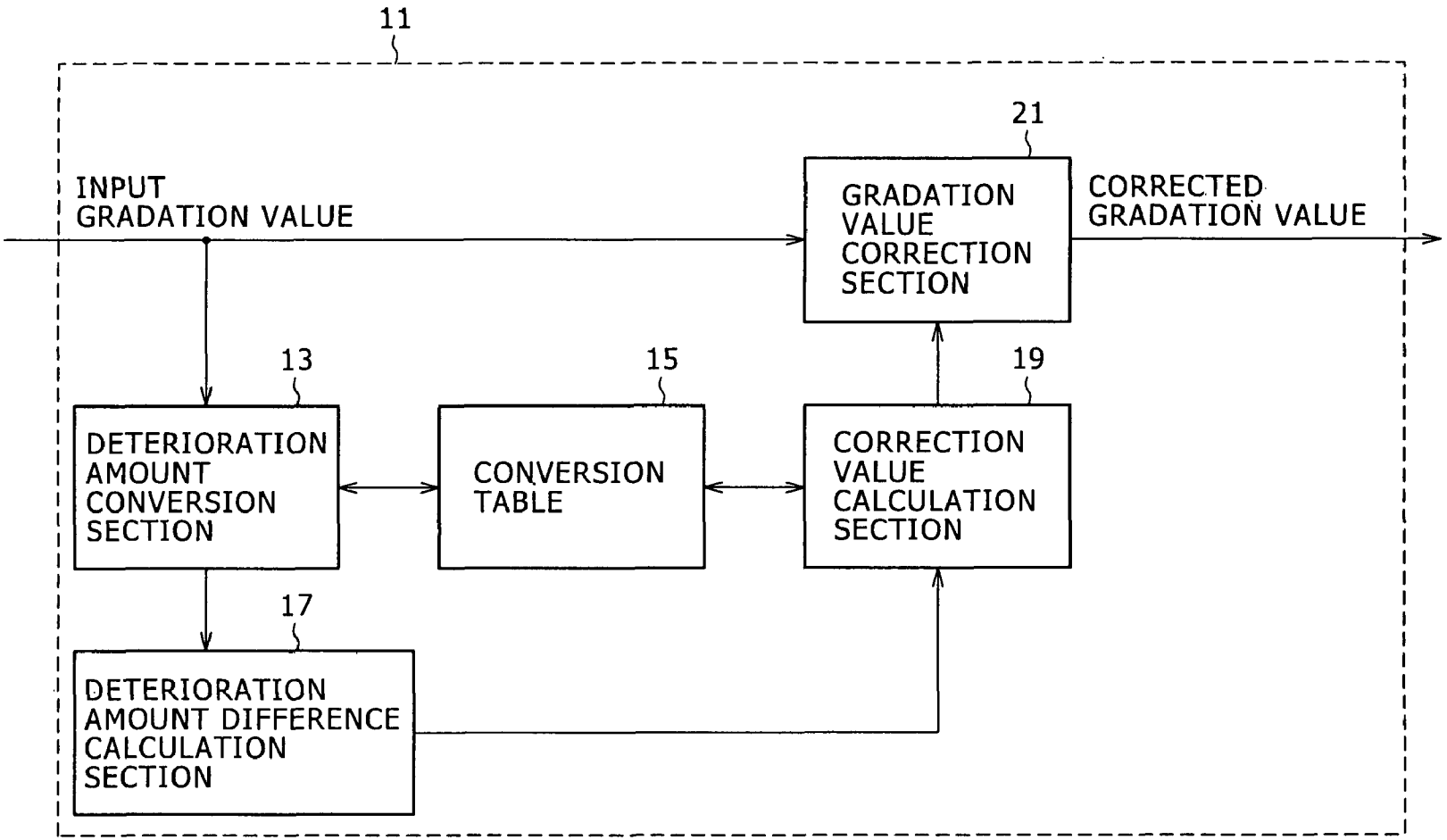
FIG. 5 is a block diagram showing another example of the sticking phenomenon correction apparatus.

FIG. 5 shows another example of a form of the sticking phenomenon correction apparatus where it is formed by hardware. The present example corresponds to a case wherein the conversion process from a gradation value to a deterioration ratio and the conversion process from the deterioration ratio to a gradation value are implemented using a conversion table.

Referring to FIG. 5, the correction apparatus 11 shown includes a deterioration amount conversion section 13, a conversion table 15, a deterioration amount difference calculation section 17, a correction value calculation section 19 and a gradation value correction section 21.

The deterioration amount conversion section 13, conversion table 15 and deterioration amount difference calculation section 17 correspond to the deterioration amount difference arithmetic operation section 3 described hereinabove. The correction value calculation section 19 corresponds to the correcting deterioration ratio calculation section 5 described hereinabove. Further, the conversion table 15, correction value calculation section 19, and gradation value correction section 21 correspond to the gradation value correction section 7 described hereinabove.

The deterioration amount conversion section 13 is a processing device which derives a deterioration ratio from an input gradation value for each pixel and calculates the deterioration amounts R (α1) and R (α2) within the light emission period t1. Here, the deterioration amount R (α1) is calculated as $R(\alpha1)=\alpha1\cdot t$ using the deterioration ratio α1. Meanwhile, the deterioration amount R (α2) is calculated as $R(\alpha2)=\alpha2\cdot t$ using the deterioration ratio α2.

The conversion table 15 is a lookup table corresponding to FIG. 2. For the conversion table 15, a conversion table from which a corresponding value can be read out when one of the gradation value and the deterioration ratio is inputted is used. However, a table for exclusive use for conversion from a gradation value into a deterioration ratio and another table for exclusive use for conversion from a deterioration ratio into a gradation value may be prevented separately from each other.

The deterioration amount difference calculation section 17 is a processing device which calculates the deterioration amount difference Y ($=R(\alpha1)-R(\alpha2)=(\alpha1-\alpha2)\cdot t1$) between two pixels.

The correction value calculation section 19 is a processing device which derives the deterioration ratio β1 for correction necessary to eliminate the calculated deterioration amount difference Y within the light emission period t2 as a correction period with reference to the deterioration ratio β1 of the pixel 2. In particular, the correction value calculation section 19 is a processing device which provides the deterioration ratio β1 as $\beta2-(\alpha1-\alpha2)\cdot t1/t2$.

The gradation value correction section 21 is a processing device which refers to the conversion table 15 with the calculated deterioration ratio β1 to determine a corresponding gradation value c and another process of replacing the gradation value of the pixel 1 with the determined gradation value c.

c. Example of Incorporation into a Self-Luminous Apparatus

Figure 6:
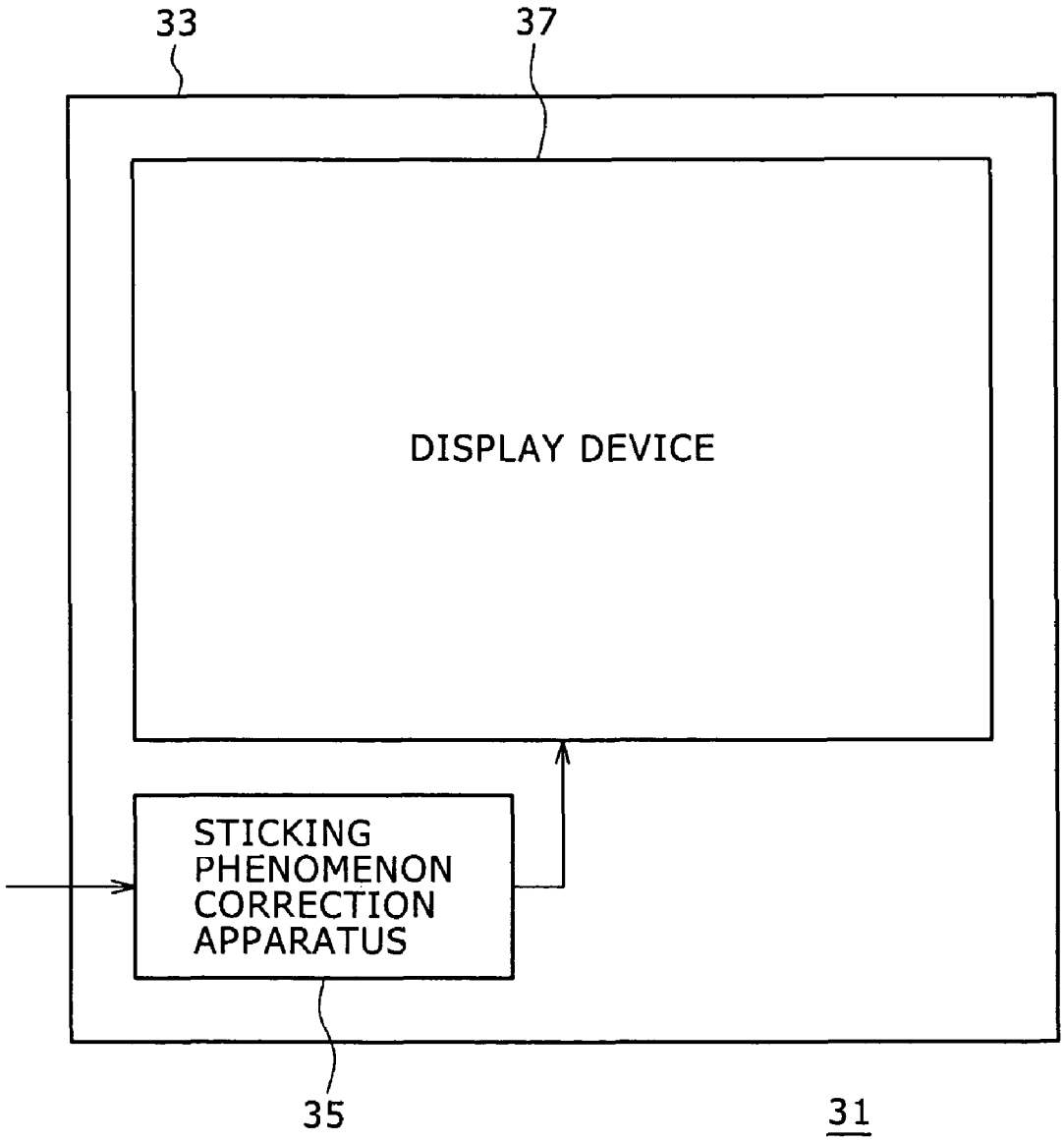
FIG. 6 is a view showing an example of a configuration of a self-luminous apparatus.

FIG. 6 shows an example of a sticking phenomenon correction apparatus incorporated in a self-luminous apparatus.

Referring to FIG. 6, the self-luminous apparatus 31 includes a sticking phenomenon correction apparatus 35 and a display device 37 accommodated in a housing 33.

The sticking phenomenon correction apparatus 35 receives a video signal at an output terminal thereof or receives a video signal generated in the inside thereof as an input thereto and executes a correction action of the gradation value so that no deterioration amount difference may appear between the correction object pixel and the reference pixel. For example, a circuit device having such a configuration as described in connection with Example 1 or Example 2 is used.

The display device 37 is composed of a display device and a drive circuit for the display device. The display device to be used may be formed from an organic EL (electroluminescence) panel, a PDP (plasma-display panel), an FED (field emission display) panel, an LED panel or a CRT.

In FIG. 6, it is shown that the sticking phenomenon correction apparatus 35 which is a processing device for exclusive use for correction of a sticking phenomenon is incorporated in the self-luminous apparatus 31. However, where the pertaining functions are all executed by software, the functions are implemented by a computer incorporated in the self-luminous apparatus.

G. Effects of the Examples

Since the deterioration amount of each pixel is measured using a deterioration ratio which is a parameter which reflects a drop of the emission light luminance, the deterioration amount of the emission light characteristic can be measured and corrected more accurately than with the prior art. In particular, even where the deterioration of the emission light characteristic does not proceed in a proportional relationship to the display gradation, a deterioration amount difference between two pixels can be corrected to zero with certainty.

Further, the correction process is executed concurrently within the light emission period, and a no-light emission period for correction is not required. Therefore, the power can be prevented from being consumed wastefully.

H. Other Forms a. In the examples described hereinabove, such a conversion table as shown in FIG. 2, that is, a conversion table wherein a single corresponding relationship between gradation values and deterioration ratios is defined, is used. However, in order to take a secular change into consideration, a plurality of conversion tables may be prepared taking time information into consideration.

b. In the examples described hereinabove, the light emission periods t1 and t2 individually have arbitrary values. However, they may otherwise be set individually in a unit of a field or in a unit of a frame. It is to be noted that the light emission period t1 and the light emission period t2 may be equal to each other. In this instance, the deterioration ratio $\beta 1$ can be implemented using only addition and subtraction.

c. In the examples described hereinabove, a corresponding relationship between gradation values and deterioration values of a unit frame is stored as a conversion table. However, a corresponding relationship between integrated values of gradation values corresponding to a plurality of frames and deterioration values may be stored instead. This is effective where each of the light emission periods t1 and t2 is set over a plurality of frames.

d. In the examples described hereinabove, an average gradation value within the light emission period t1 may be used to calculate the deterioration amount difference Y while an average deterioration ratio within the light emission period t2 is used to calculate the deterioration amount difference H. In this instance, an average deterioration amount difference which appears between two pixels in the light emission period t1 and an average deterioration ratio $\beta 1$ with which an average deterioration amount appearing with the reference pixel within the light emission period t2 is eliminated can be derived.

e. In the examples described above, a sticking phenomenon is corrected while the apparatus remains in a used state. However, a sticking phenomenon may be corrected otherwise while the apparatus is not in a used state.

f. In the examples described hereinabove, the single conversion table 15 is incorporated. However, where the deterioration ratio and the gradation value vary as time passes, a plurality of different conversion tables may be prepared in accordance with the lapse of time. In this instance, preferably a timer for measuring the time length of light emission is prepared.

If the conversion table to be referred to is changed over in response to the time length of light emission from an initial state, then even where the relationship between the deterioration ratio and the gradation value varies, accurate deterioration amounts and an accurate deterioration amount difference can be calculated.

g. The examples described above can be modified in various manners within the spirit and scope of the present invention. Also various modifications and applications may be made which are created in accordance with the disclosure of the present specification and/or the accompanying drawings.

What is claimed is:

1. A sticking phenomenon correction method for correcting a sticking phenomenon of a self-luminous apparatus wherein a plurality of self-luminous elements are arranged in a matrix while said self-luminous apparatus is in a used state, comprising the steps of:

calculating a deterioration amount difference appearing between a correction object pixel and a reference pixel within a first light emission period of time using a deterioration ratio derived from gradation values of the pixels;

deriving a deterioration ratio for correction for the correction object pixel necessary to eliminate the calculated deterioration amount difference within a second light emission period of time using a deterioration ratio of the reference pixel;

converting the derived deterioration ratio for correction into a corresponding gradation value; and driving the correction object pixel to emit light with the converted gradation value.

2. The sticking phenomenon correction method according to claim 1, wherein that one of said self-luminous elements which corresponds to the correction object pixel and another one of said self-luminous elements which corresponds to the reference pixel satisfy an initial condition that the self-luminous elements emit light with the luminances equal to each other in the same driving condition.

3. The sticking phenomenon correction method according to claim 1, wherein the reference pixel is set for each of plural ones of said self-luminous elements which emit light with the same color.

4. The sticking phenomenon correction method according to claim 1, wherein the reference pixel is a pixel set imaginarily for the calculation of a correction amount.

5. The sticking phenomenon correction method according to claim 1, wherein the corresponding relationship between the deterioration ratio and the gradation value is given taking elapsed time information into consideration.

6. The sticking phenomenon correction method according to claim 1, wherein a correspondence that is established between relative degradations of pixels and corrective gradation data is to be applied over a particular period of time.

7. The sticking phenomenon correction method according to claim 1, wherein a deterioration amount difference Y appearing between a certain correction object pixel and the reference pixel within a first light emission period t1 is calculated as $Y=(\alpha 1-\alpha 2)\cdot t1$ where $\alpha 1$ is the deterioration ratio of the correction object pixel and $\alpha 2$ is the deterioration ratio of the reference pixel within the first light emission period, and then a deterioration ratio $\beta 1$ of the correction object pixel necessary to eliminate the deterioration amount difference Y within the second light emission period t2 is calculated as $\beta 1=\beta 2-Y/t2$ where $\beta 2$ is the deterioration ratio of the reference pixel within the second light emission period.

8. A self-luminous apparatus wherein a plurality of self-luminous elements are disposed in a matrix on a substrate, comprising:

a deterioration amount difference arithmetic operation section for calculating a deterioration amount difference appearing between a correction object pixel and a reference pixel within a first light emission period of time using a deterioration ratio derived from gradation values of the pixels;

a correcting deterioration ratio calculation section for deriving a deterioration ratio for correction for the correction object pixel necessary to eliminate the calculated deterioration amount difference within a second light emission period of time using a deterioration ratio of the reference pixel; and a gradation value correction section for converting the derived deterioration ratio for correction into a corresponding gradation value and driving the correction object pixel to emit light with the converted gradation value.

9. A self-luminous apparatus wherein a plurality of self-luminous elements are disposed in a matrix on a substrate, comprising:

a conversion table for retaining a coordinated relationship between gradation values and deterioration ratios of said self-luminous elements;

a deterioration amount difference arithmetic operation section for converting gradation values of said pixels into deterioration ratios using said conversion table and calculating a deterioration amount difference appearing between each correction object pixel and a reference pixel within a first light emission period of time;

a correcting deterioration ratio calculation section for deriving a deterioration ratio for correction for the correction object pixel necessary to eliminate the calculated deterioration amount difference within a second light emission period of time using a deterioration ratio of the reference pixel; and a gradation value correction section for converting the derived deterioration ratio for correction into a corresponding gradation value using said conversion table and driving the correction object pixel to emit light with the converted gradation value.

10. A self-luminous apparatus wherein a plurality of self-luminous elements are disposed in a matrix on a substrate, comprising:

a first arithmetic operation section for converting gradation values of pixels into deterioration ratios by an arithmetic operation process;

a deterioration amount difference arithmetic operation section for calculating a deterioration amount difference appearing between each correction object pixel and a reference pixel within a first light emission period using the deterioration ratios obtained by the conversion process;

a correcting deterioration ratio calculation section for deriving a deterioration ratio for the correction object pixel necessary to eliminate the calculated deterioration amount difference within a second light emission period using the deterioration ratio of the reference pixel;

a second arithmetic operation section for converting the derived deterioration ratio for correction into a gradation value by an arithmetic operation process; and a gradation value correction section for driving the correction object pixel to emit light with the gradation value determined by the conversion process.

11. A sticking phenomenon correction apparatus for a self-luminous apparatus wherein a plurality of self-luminous elements are disposed in a matrix on a substrate, comprising:

a deterioration amount difference arithmetic operation section for calculating a deterioration amount difference appearing between a correction object pixel and a reference pixel within a first light emission period of time using a deterioration ratio derived from gradation values of the pixels;

a correcting deterioration ratio calculation section for deriving a deterioration ratio for correction for the correction object pixel necessary to eliminate the calculated deterioration amount difference within a second light emission period of time using a deterioration ratio of the reference pixel; and a gradation value correction section for converting the derived deterioration ratio for correction into a corresponding gradation value and driving the correction object pixel to emit light with the converted gradation value.

12. A non-transitory computer-readable storage medium having a program for causing a computer incorporated in a self-luminous apparatus wherein a plurality of self-luminous elements are disposed in a matrix to execute:

a process of calculating a deterioration amount difference appearing between a correction object pixel and a reference pixel within a first light emission period of time using a deterioration ratio calculated from gradation values of the pixels;

a process of deriving a deterioration ratio for correction for the correction object pixel necessary to eliminate the calculated deterioration amount difference within a second light emission period of time using a deterioration ratio of the reference pixel;

a process of converting the calculated deterioration ratio for correction into a corresponding gradation value; and a process of driving the correction object pixel to emit light with the converted gradation value;

wherein a sticking phenomenon of said self-luminous apparatus is corrected while said self-luminous apparatus is in a used state.

* * * * *